United States Patent [19]

Venäläinen

[11] 4,250,736

[45] Feb. 17, 1981

[54] CLAMPING APPARATUS FOR TRANSMITTING A TRACTION FORCE

[76] Inventor: Teuvo O. Venäläinen, Luistelijantie 9 E, 70200 Kuopio 20, Finland

[21] Appl. No.: 35,300

[22] Filed: May 2, 1979

[30] Foreign Application Priority Data

May 4, 1978 [FI] Finland ..... 781376

[51] Int. Cl.[3] ..... B21D 1/12

[52] U.S. Cl. ..... 72/479; 72/705

[58] Field of Search ..... 72/705, 293, 392, 311, 72/479; 279/97; 294/93

[56] References Cited

U.S. PATENT DOCUMENTS

| | | | |
|---|---|---|---|
| 3,015,353 | 1/1962 | Brown | 72/705 X |
| 3,241,352 | 3/1966 | Lincourt | 72/705 X |
| 3,258,821 | 7/1966 | Curran | 72/705 X |
| 3,338,086 | 8/1967 | Hunter | 72/705 X |
| 3,526,120 | 9/1970 | Hunnicutt et al. | 72/705 X |
| 3,631,705 | 1/1972 | McCaffrey | 72/705 X |
| 3,927,550 | 12/1975 | Samuelsson | 72/705 X |

*Primary Examiner*—Lowell A. Larson

*Attorney, Agent, or Firm*—Steinberg & Raskin

[57] ABSTRACT

Clamping apparatus for transmitting a traction force to a metallic workpiece, such as an automobile body or the like, for deforming the same includes a frame including a clamping head housing portion having a cylindrical cavity formed therein, a clamping head assembly including a clamping head body having a cylindrical section and a pair of jaw portions, the cylindrical section portion of the clamping head body having a circumferentially extending groove formed therein with which is aligned the shank portion of a set screw which extends through the clamping head housing portion to fix the clamping head assembly, which is otherwise rotatable within the housing, with respect to the frame. The frame is provided with three appropriately formed areas for attaching a pulling bridle thereto for selectively applying a traction force either in a direction perpendicular to the plane of the clamping jaw portions, parallel to the plane thereof or in a direction 45° to the plane thereof. In this manner, it is possible to transmit to the workpiece a traction force having the precise desired direction required for the particular deformation.

14 Claims, 3 Drawing Figures

CLAMPING APPARATUS FOR TRANSMITTING A TRACTION FORCE

BACKGROUND OF THE INVENTION

The present invention relates generally to clamping apparatus and, more particularly, to clamping apparatus for transmitting a traction force to a metallic workpiece, such as in connection with the repair of automobile bodies, for deforming the metallic workpiece.

Clamping apparatus adapted to be attached to metallic workpieces for the purpose of transmitting traction forces to such workpieces are, of course, well known. For example, in connection with repairing the bodies of automobiles which have been involved in collisions or other accidents, clamping apparatus have been utilized which are fixed to the dented area of the automobile body for the purpose of transmitting a traction force applied by a pulling bridle to that body area for the purpose of straightening or deforming the same to its original configuration.

However, such conventional clamping apparatus are not entirely satisfactory for several reasons. More particularly, in general, conventional clamping apparatus of the type described above can transmit traction forces in only a single direction at any one time. Thus, should it be required during the repair operation on an automobile body to change the direction of the traction force, it is necessary to detach the clamping apparatus and reaffix the same in a new more appropriate orientation with respect to the body. Further, even recognizing that a conventional clamping apparatus can be detached and reaffixed to the body to vary the direction of the traction force, such clamping apparatus still generally do not provide an unlimited choice for the pulling or traction forces. Thus, most of the prior art clamping apparatus of this type provide only a single direction in which the traction force can be applied to the workpiece, namely in the direction of the clamping angle of the jaws.

Although clamping apparatus are known wherein the traction force can be applied at right angles to the clamping jaws as well as in the direction thereof, such a limited choice for the direction of the traction force is still not sufficient to provide a capability of repairing the damaged automobile body without the necessity of several detachment and reaffixing operations. Thus, conventional clamping apparatus of this type still cannot transmit a traction force in the precise desired direction, should the latter be other than in the direction of or at right angles to the clamping jaw.

SUMMARY OF THE INVENTION

Accordingly, one object of the present invention is to provide new and improved clamping apparatus for transmitting a traction force to a metallic workpiece, such as an automobile body or the like, for deforming the same.

Another object of the present invention is to provide such a new and improved clamping apparatus which is capable of transmitting a traction force in any desired direction relative to the workpiece being deformed and to maintain this direction during the deforming process, all without the necessity of detaching and reaffixing the clamping apparatus.

Still another object of the present invention is to provide such a new and improved clamping apparatus having a simplified construction relative to conventional clamping apparatus and which is therefore inexpensive in manufacture.

In accordance with the present invention, these and other objects are attained by providing clamping apparatus including a frame having a clamping head housing portion defining a cavity therewithin, a clamping head assembly rotatably mounted within the housing portion including a pair of opposed clamping jaw portions which are movable into a clamping relationship with the workpiece, and apparatus for selectively locking the clamping head assembly in a fixed, immovable relationship with respect to the frame. In this manner, the frame is rotatable with respect to the clamping head assembly into any desired angular orientation with respect thereto. When the desired angular orientation of the frame with respect to the clamping head assembly is attained, the frame is immovably locked to the clamping head assembly. In this manner a traction force can be applied such, for instance, in the context of automobile body rectification, in any desired direction. The particular device provided for selectively locking the clamping head assembly with respect to the frame ensures that the particular desired traction angle will be maintained during the time in which the traction force is applied to the workpiece.

Thus, the clamping apparatus of the present invention need not be detached from the workpiece when it is required to change the direction of the traction force being applied thereto. More particularly, it is only necessary to unlock the clamping head assembly relative to the frame, rotate the frame relative to the clamping assembly and relock the apparatus to change the traction force direction. In the case where the clamping apparatus is utilized in connection with automobile body rectification, the direction of the traction force which, of course, comprises the direction in which the metal is being deformed, can be changed to be in the direction of the length, height and breadth directons of the automobile. As a consequence of this capability, the time required for repairing the damaged automobile body is reduced significantly relative to the time required when using clamping apparatus of conventional design.

The clamping apparatus of the present invention has the further capability of transmitting the traction force in any desired direction while the clamping head assembly is maintained in clamped relationship with an appropriate seam on the workpiece. For example, studies conducted in the past have demonstrated that among the most favorable areas for attachment of the clamping apparatus such as in connection with automobile body rectification, are those areas where two or more metallic sheets are joined by spot welding, for example, i.e., where a seam is formed. Such areas include window and door frames, skirt boxes, fenders, etc. Although conventional clamping apparatus are suitable for attachment to such seams, upon such attachment, such conventional clamping apparatus provide only a limited choice for the direction in which the traction force can be transmitted to the area. According to the present invention, clamping apparatus are provided which can be attached to such favorable seam areas while allowing an unlimited choice for the direction in which the traction force is applied. Of course, the clamping apparatus of the present invention is provided with appropriate means for maintaining the particular desired direction of the traction force during the time within which this force is applied.

DESCRIPTION OF THE DRAWINGS

A more complete appreciation of the present invention and many of the attendant advantages thereof will be readily appreciated as the same become better understood by reference to the following detailed description when considered in connection with the accompanying drawing in which.

DESCRIPTION OF THE PREFERRED EMBODIMENTS

Figure 1:
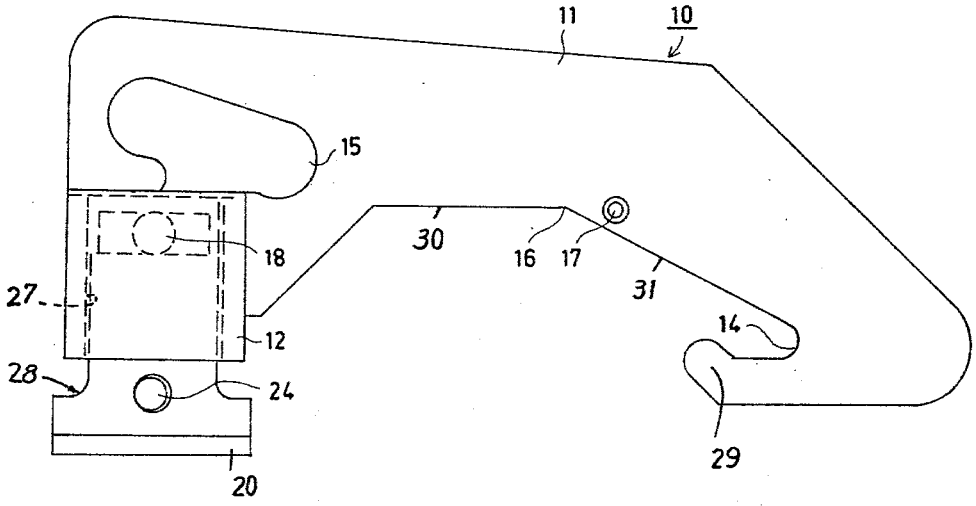
FIG. 1 is a side elevation view of the clamping apparatus according to the present invention.
Figure 2:
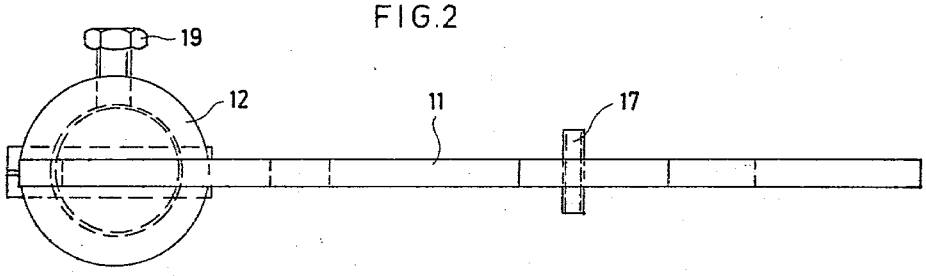
FIG. 2 is a plan view of the clamping apparatus of the present invention as illustrated in FIG. 1.

Referring now to the drawings wherein like reference characters designate identical or corresponding parts throughout the several views, the clamping apparatus of the present invention, generally designated 10, generally comprises a substantially C-shaped frame 11 having a clamping head housing portion 12 provided at one end thereof, the housing portion having a cylindrical recess 27 formed therein. A clamping head assembly, generally designated 28, described in detail below, is rotatably located within the recess 27 which are movable towards each other for clamping the workpiece therebetween, the clamping head assembly having a pair of jaw portions 20, 21 located exteriorly of the recess 27. Means for locking the clamping head assembly 28 within the housing portion 12 in a manner such that the frame 11 is fixed relative to the clamping jaws 20, 21 are provided and are described in detail below.

Referring to FIG. 1, the frame 11 is constructed so as to define a plurality of areas to which a pulling bridle can be attached for applying a traction force to the clamping apparatus. Thus, a traction area 14 is defined at the right end region of frame 11 (as seen in FIG. 1) by a hook-shaped extension 29 of frame 11. Thus, traction area 14 comprises means for attaching a pulling bridle to the clamping apparatus for applying a traction force substantially in the direction of the plane defined by the clamping jaw portions 20, 21, i.e., the plane within which the clamping jaw portions are movable toward and away from each other during the clamping operation. A traction area 15 is defined at the left end region of frame 11 (as seen in FIG. 1), the traction area 15 comprising a means for attaching a pulling bridle to the clamping apparatus for applying a traction force thereto substantially in a direction perpendicular to the plane of the clamping jaw portions 20, 21. A third traction area 16 is defined on frame 11 at the intersection of a pair of adjacent interior edge surfaces 30, 31, the latter being appropriately formed so that the traction area 16 comprises means for attaching a pulling bridle to the clamping apparatus for applying a traction force substantially in a direction of 45° to the plane of the clamping jaw portions. In this connection, a tubular cotter pin 17 extends through frame 11 in the region of traction area 16. The tubular cotter pin 17 provides additional support for the pulling bridle when the traction area 16 is utilized.

The clamping head housing portion 12 of frame 11 preferably comprises a cylindrical, cup-shaped member rigidly fixed, such as by welding, to the left end region of frame 11. A threaded bore 18 passes through the wall of housing portion 12 for purposes which will be made clear hereinbelow.

Figure 3:
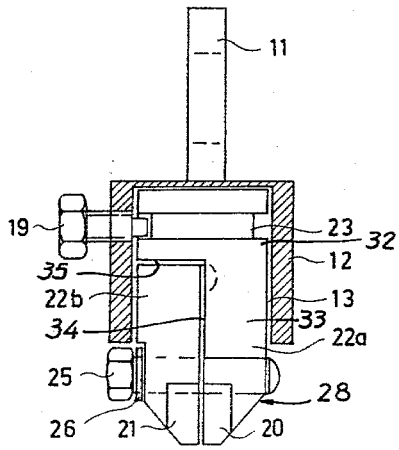
FIG. 3 is a front elevation view in partial section of the clamping apparatus of the present invention.

The clamping head assembly 28, as best seen in FIGS. 1 and 3, comprises a clamping head body **22*a* defined by an upper cylindrical portion 32 and an integral lower portion 33 having a substantially semi-cylindrical cross-section. A clamping jaw 20 is provided as an insert within a recess formed at the lower end region (as seen in FIG. 3) of clamping head body 22*a*. A second body 22*b* having a substantially semi-cylindrical cross-section is located in the space defined by the vertical planar surface 34 and downwardly facing horizontal surface 35 of the clamping head body 22*a*. The jaw portion 21 is provided in a recess formed at the lower end region of second body 22*b* in the same manner as jaw portion 20. A pair of aligned threaded bores are formed in clamping head and second bodies 22*a, b* in which a clamping screw 25 is provided, a washer 26 being interposed between the head of screw 25 and a flat area formed on the outer surface of second body 22*b*. Through suitable rotation of clamping screw 25, the jaw portions 20, 21 of clamping head assembly 28** can be moved towards each other to clamp the clamping head assembly to the workpiece.

The clamping head assembly 28 is located within recess 27 of housing portion 12 as seen in FIG. 3 so as to be rotatable therewithin. The upper portion 32 of clamping head body **22*a* has a circumferentially extending locking groove 23 formed therein in a manner such that upon locating the clamping head assembly 28 within recess 27, groove 23 is aligned with the threaded bore 18 provided in housing portion 12, as described above. A set screw 19 is threadedly located within bore 18 and has its shank portion extending within the locking groove 23. Thus, it is readily seen that the frame 11 is rotatable with respect to the clamping head assembly 28, the latter being normally held for rotation within housing portion 12 by means of set screw 19. When set screw 19 is fully tightened, the clamping head assembly 28 is immovably secured to frame 11. In other words, the frame 11** is continuously rotatable with respect to an axis which extends substantially normal to the plane of the clamping jaw portions and within a plane which extends substantially in the same direction as the plane of the clamping jaw portions. In this manner, a traction force can be applied either in the direction of the edge clamped by the jaws or at any desired angle thereto.

In operation, clamping screw 25 is first loosened so that the jaw portions 20, 21 can be applied to the workpiece, such for example, as the seam on a dented area on an automobile body. The clamping screw 25 is then tightened so that the clamping head assembly 28 becomes fixed to the workpiece. With the set screw 19 in its loosened condition, the frame 11 is rotated so as to extend in the direction in which it is desired to apply the traction force, whereupon set screw 19 is tightened so that the clamping head assembly 28 is immovably secured to frame 11.

If the desired direction of the traction force is parallel to the plane defined by the jaw portions 20, the pulling bridle is associated with frame 11 on the traction area 14 thereof. If the desired direction of the traction force is 45° to the plane of the jaw portions 20, 21 the pulling bridle is applied at traction area 16, behind the tubular cotter pin 17. Finally, should it be desired to apply an outwardly directed traction force to the material being deformed, i.e., in a direction perpendicular to the plane defined by the jaw portions 20, 21, the pulling bridle is applied at traction area 15 by passing the bridle through the loop-shaped aperture defining the same.

From the foregoing, it is seen that the present invention provides a clamping apparatus for transmitting a traction force to a metallic workpiece. In the example wherein the clamping apparatus is used in connection with automobile body repair work, the application of a traction force in both the longitudinal and height directions of the automobile body can be accomplished by a single attachment of the clamping apparatus of the present invention by applying a pulling bridle at traction area 15 to accomplish the transmission of the traction force in the height direction of the body while another pulling bridle is applied at the traction area 14 of frame 11 to accomplish the transmission of the traction force in the longitudinal direction. Should it become apparent during the course of the metal deformation that the direction of the traction force is not ideal, i.e., in the lateral direction, it is only necessary that the set screw 19 be loosened and the frame 11 be rotated with respect to the clamping head assembly to the proper angular position whereupon the set screw 19 is tightened. From the above, it is apparent that the clamping apparatus 10 of the present invention provides a means for effecting the transmission of a traction force to a workpiece in several different directions in a simple and fast manner thereby rendering such deformation significantly more efficient than has been possible heretofore.

Obviously, numerous modifications and variations of the present invention are possible in the light of the above teachings. Accordingly, it is understood that within the scope of the appended claims, the invention may be practiced otherwise than as specifically disclosed herein.

What is claimed is:

1. Clamping apparatus for transmitting a traction force to a metallic workpiece, such as an automobile body or the like, for deforming the same, comprising:

a frame including a clamping head housing portion having a recess formed therein;

a clamping head assembly including a pair of opposed clamping jaw portions selectively actuatable for movement within a plane into clamping relationship with the workpiece, said clamping head assembly being mounted for rotation within said housing portion recess in a manner such that said frame is continuously rotatable with respect to the clamping head assembly with respect to an axis which extends substantially normal to the plane of the clamping jaw portions and within a plane which extends in substantially the same direction as the plane of the clamping jaw portions; and means for selectively locking said clamping head assembly in a fixed, immovable relationship with respect to said frame whereby the frame is rotatable within a plane which extends substantially in the same direction as the plane of the clamping jaw portions to a desired angular location with respect to said clamping head assembly jaw portions, said jaw portions being clamped to said workpiece, whereupon said locking means are actuatable to immovably fix said frame with respect to said clamping head assembly, so that a traction force can be applied to said workpiece through the clamping apparatus in any desired direction within a plane which extends substantially in the same direction as the plane of the clamping jaw portions to form said workpiece.

2. Clamping apparatus as recited in claim 1 wherein said housing portion has a cylindrical recess formed therein and said clamping head assembly comprises a clamping head body having a surface defining at least a portion of a cylindrical surface.

3. Clamping apparatus as recited in claim 2 wherein said clamping head body includes a cylindrical portion having a circumferentially extending locking groove formed therein.

4. Clamping apparatus as recited in claim 3 wherein said locking means comprises a set screw having a shank portion which extends into said cylindrical cavity of said clamping head housing portion, said clamping head body being located within said cavity such that said set screw shank portion is aligned with and is adapted to extend into said groove.

5. Clamping apparatus as recited in claim 4 wherein said clamping body is defined by a semi-cylindrical portion, one of said jaw portions being provided at one end region thereof, and said cylindrical portion intergrally extending from said semi-cylindrical portion opposite from said jaw portion, and a second clamping body having a substantially semi-cylindrical section, the other of said jaw portions being provided at one end region thereof.

6. Clamping apparatus as recited in claim 5 further including means for moving said clamping body portion and second body portion together to bring said jaw portions into clamped relationship.

7. Clamping apparatus as recited in claim 6 wherein said moving means comprises a clamping screw extending through said clamping and second body portions.

8. Clamping apparatus as recited in claim 1 wherein said frame includes means for attaching a pulling bridle thereto for applying a traction force substantially in the direction of the plane of the clamping jaw portions.

9. Clamping apparatus as recited in claim 8 wherein said attachment means comprises a slot formed in said frame.

10. Clamping apparatus as recited in claim 1 wherein said frame includes means for attaching a pulling bridle thereto for applying a traction force substantially in a direction perpendicular to the plane of the clamping jaw portions.

11. Clamping apparatus as recited in claim 10 wherein said attachment means comprise a loop-shaped aperture formed in said frame.

12. Clamping apparatus as recited in claim 1 wherein said frame includes means for attaching a pulling bridle thereto for applying a traction force substantially in a direction of 45° to the plane of the clamping jaw portion.

13. Clamping apparatus as recited in claim 12 wherein a tubular cotter pin is affixed to said frame in the region of said attachment means for facilitating support of said pulling bridle when said attachment means is utilized.

14. Clamping apparatus as recited in claim 1 wherein said frame includes first, second and third means for attaching a pulling bridle thereto, said first attaching means adapted to apply a traction force substantially in the direction of the plane of the clamping jaw portions, said second attaching means adapted to apply a traction force substantially in a direction perpendicular to the plane of the clamping jaw portions, and said third attaching means adapted to apply a traction force substantially in a direction 45° to the plane of the clamping jaw portions.

* * * * *